US005992421A

United States Patent [19]

Bae

[11] Patent Number: 5,992,421

[45] Date of Patent: Nov. 30, 1999

[54] ALTERNATE CIGARETTE AND METHOD FOR PREPARING THE SAME

[76] Inventor: Oh Sung Bae, #702, New Hyundai-Rivervill, 130-10 Chungdam-Dong, Kamgnam-Ku, Seoul 135-100, Rep. of Korea

[21] Appl. No.: 08/919,967

[22] Filed: Aug. 28, 1997

[51] Int. Cl.[6] ..... A24B 15/10

[52] U.S. Cl. ..... 131/369; 131/359; 131/352

[58] Field of Search ..... 131/359, 369, 131/352, 296, 292

[56] References Cited

U.S. PATENT DOCUMENTS

| | | | |
|---|---|---|---|
| 3,034,931 | 5/1962 | Kiefer | 131/2 |
| 3,867,951 | 2/1975 | Buchmann et al. | 131/2 |
| 5,074,321 | 12/1991 | Gentry et al. | 131/352 |

*Primary Examiner*—Stanley S. Silverman
*Assistant Examiner*—Steven B. Leavitt
*Attorney, Agent, or Firm*—Michael N. Meller; Eugene Lieberstein

[57] ABSTRACT

An alternate cigarette is in a form of cigar or cigarette with a moisture content of 12–13%, which is prepared from a composition comprising a herb medicinal mixture of *Artemisia vulgaris Linne, Morus bombycis Koidzumi, Ziziphus jujuba Miller, Polygala tenuifolia Willdenow, Asiasarum heterotropoides var. seoulense F. Maekawa, Eugenia caryophyllata Thunberg, Cnidium officinale Makino, Evodia officinalis Dode* and *Thuja orientalis Linne* powders and *Arisaema amurense Max var. Serratum Nakai, Angelica koreana Maximowicz and Brassica juncea Cosson* extracts, in combination with 1–10 wt % of starch syrup and 0.1–1 wt % of glycerol on the basis of the weight of the herb medicinal mixture. With the alternate cigarette, a smoker can be restrained from smoking, get rid of tension and stress and relieve himself or herself from the smoking motives, such as psychological tone, anxiousness, wrath, melancholy, etc, while feeling a smoking sense and not experiencing medical effects including cough remedy and discharge of phlegm.

18 Claims, 1 Drawing Sheet

ALTERNATE CIGARETTE AND METHOD FOR PREPARING THE SAME

BACKGROUND OF THE INVENTION

1. Field of the invention

The present invention relates to a novel smoking favorite which is harmless and, more particularly, to a non-toxic alternate cigarette with which a smoking sense and abstinence from smoking can be effected.

2. Description of the Prior Art

Nicotiana tabacum, an annual grass which belongs to a tobacco genus of an eggplant family, is cultivated to use its leaves.

Generally, tobacco leaves are known to contain such harmful ingredients as nicotine and tar at an amount of 1–8%. Particularly, as many as about 4,000 chemicals are present in the smoke of tobacco and it is well known that smoking is a main cause of various diseases including lung cancer and coronary artery disorder. The bad effect of smoking was examined since 1930s and is now found to be mainly attributed to the carcinogen (tar) and the toxicant (nicotine). In fact, it is reported that the attack rate with lung cancer increases as a smoking population increases and non-smokers suffer from the smoke from smokers.

Nicotine, a colorless, volatile liquid alkaloid, is so fatally poisonous and it stimulates the nerve tissues, such as cerebral nerve, cerebellum and affects vertebra leading to paralysis. Recently, with an increasing interest in carcinogenesis, many researchers have reported that nicotine could cause carcinomas in lung, larynx and esophagus.

SUMMARY OF THE INVENTION

Therefore, it is an object of the present invention to provide a non-poisonous alternate cigarette, with which a smoker can be restrained from smoking, get rid of tension and stress and relieve himself or herself from the smoking motives, such as psychological tone, anxiousness, wrath, melancholy, etc, while feeling a smoking sense and experiencing medical effects such as cough remedy and discharge of phlegm.

It is another object of the present invention to provide a method for preparing an alternate cigarette.

In accordance with an aspect of the present invention, there is provided a method for preparing an alternate cigarette, which comprises mixing starch syrup and glycerin at an amount of 1–10 wt % and 0.1–1 wt %, respectively, based on the weight of a herb medicinal mixture of powders from *Artemisia vulgaris Linne, Morus bombycis Koidzumi, Ziziphus jujuba Miller, Polygala tenuifolia Willdenow, Asiasarum heterotropoides var. seoulense F. Maekawa, Eugenia caryophyllata Thunberg, Cnidium officinale Makino, Evodia officinalis Dode* and *Thuja orientalis Linne* and extracts from *Arisaema amurense Max var. Serratum Nakai, Angelica koreana Maximowicz* and *Brassica juncea Cosson*, drying the resulting mixture to a moisture content of 12–13% and making it into a form of cigar or cigarette.

DETAILED DESCRIPTION OF THE INVENTION

Figure 1:
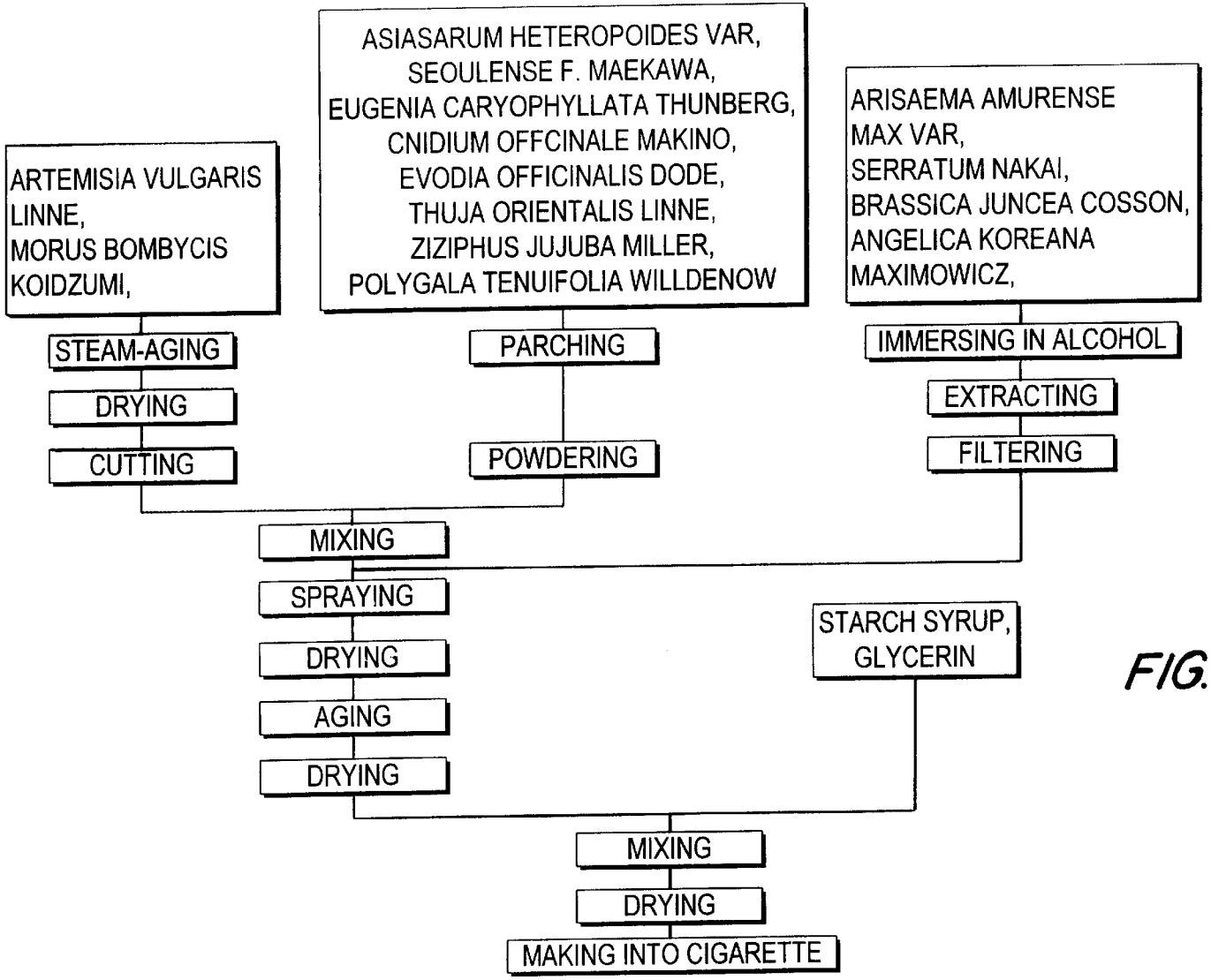
FIG. 1 is a flow chart illustrating processes for preparing an alternate cigarette, in accordance with the present invention.

In accordance with the present invention, the alternate cigarette according to the present invention is in a form of a cigar or cigarette which has a moisture content of 12–13% and is prepared from a herb medicinal composition comprising the powders of *Artemisia vulgaris Linne, Morus bombycis Koidzumi, Ziziphus jujuba Miller, Polygala tenuifolia Willdenow, Asiasarum heterotropoides var. seoulense F. Maekawa, Eugenia caryophyllata Thunberg, Cnidium officinale Makino, Evodia officinalis Dode and Thuja orientalis Linne* and the extracts from *Arisaema amurense Max var. Serratum Nakai, Angelica koreana Maximowicz* and *Brassica juncea Cosson* in combination with starch syrup and glycerol.

The herb medicinal composition consists of a solid portion comprising 7–38 wt % of *Artemisia vulgaris Linne, Ziziphus jujuba Miller, Polygala tenuifolia Willdenow, Asiasarum heterotropoides var. seoulense F. Maekawa, Eugenia caryophyllata Thunberg, Evodia officinalis Dode* and *Thuja orientalis Linne* each and 10–41 wt % of *Morus bombycis Koidzumi and Cnidium officinale Makino* each and a liquid portion comprising 15–30 wt % of *Arisaema amurense Max var. Serratum Nakai, Angelica koreana Maximowicz and Brassica juncea Cosson* extracts each based on the weight of the solid portion.

In the herb medical documents of Korea, the above-mentioned herbs are recorded to exhibit various pharmaceutical effects.

First, *Artemisia vulgaris Linne* is so warm in temper that it can be useful to treating the abdominal pain and the lumbago, attributed to a chill of internal body, by internal administration or moxacautery. In addition, *Artemisia vulgaris Linne* is prescribed for anaemia prevention, anti-inflammation, neuralgia relief, anti-carcinogenesis, uterus strengthening and digestion promotion.

*Morus bombycis Koidzumi* is a root shell of a mulberry tree and is recorded to be effective for hypertension, pneumonia, cough remedy, discharge of phlegm, cholesterol removal, and diabetes.

*Arisaema amurense Max var. Serratum Nakai*, a perennial herb, contains saponin, cyperine, benzoic acid and starch in large quantities and is effective for cough remedy, discharge of phlegm, asthma, paralysis, lung cancer, headache, emesis, hypertension, senile dementia, neuralgia, and myalgia.

As for *Angelica koreana Maximowicz*, it is a perennial herb which belongs to a family of Umbelliferea and is effective for paralysis, hemiplegia, neuralgia, arthritis and headache.

As a seed of leaf mustard, *Brassica juncea Cosson* is reported to be effective for cough remedy, discharge of phlegm, asthma and neuralgia.

*Asiasarum heterotropoides var. seoulense F. Maekawa* is a perennial herb which is prescribed for headache, heat disease and paralysis.

*Eugenia caryophyllata Thunberg* is a dried clove bud, which is so hot in temper and harmless that it is effective for dyspepsia, feeble appetite and gastritis.

Being effective for headache, neuralgia, hypertension and arthritis, *Cnidium officinale Makino* is a perennial herb belonging to a family of Umbelliferea.

*Evodia officinalis Dode* is a dried premature fruit prescribed for senile dementia, metabolism promotion and anti-carcinogenesis.

*Thuja orientalis Linne* is a seed of a thuja tree which is recorded to be prescribed for sleeplessness, hypertension, paralysis, heart disease and nervous breakdown.

*Ziziphus jujuba Miller* is a seed of the Dahurian buckthorn, showing a medicinal effect for sleeplessness, nervous breakdown, headache and heart disease.

As for *Polygala tenuifolia Willdenow*, it is a root of *Polygala tenuifolia* or *P. sibiricva* which is recorded to show a high clinical effect for headache, senile dementia, memory enhancement, heart disease, nerve sedateness and sleeplessness.

The invention excludes the dangerous cause attributable to nicotine by replacing tobacco leaves with the herb composition. The alternate in accordance with the present invention allows a feeling of the smoking sense while providing effects peculiar to herb medicine, such as cough remedy, discharge of phlegm and nerve sedateness.

Although the herb ingredients are not particularly limited in quantities, each of them is preferably formulated in order to act to the best of its medicinal effects while being harmless to the human body as a component of a favorite. In this regard, the herb composition comprises a solid portion consisting of 7–38 wt % of *Artemisia vulgaris Linne, Ziziphus jujuba Miller, Polygala tenuifolia Willdenow, Asiasarum heterotropoides var. seoulense F. Maekawa, Eugenia caryophyllata Thunberg, Evodia officinalis Dode* and *Thuja orientalis Linne* powders each and 10–41 wt % of *Morus bombycis Koidzumi* and *Cnidium officinale Makino* powders each and a liquid portion comprising 15–30 wt % of *Arisaema amurense Max var. Serratum Nakai, Angelica koreana Maximowicz* and *Brassica juncea Cosson* extracts each in alcohol based on the weight of the solid portion.

To prepare the alternate cigarette according to the present invention, first, *Artemisia vulgaris Linne* and *Morus bombycis Koidzumi* are steamed for 1 hour. While *Arisaema amurense Max var. Serratum Nakai, Brassica juncea Cosson* and *Angelica koreana Maximowicz* are immersed in 50–70% alcohol for 100 days to extract pharmaceutical components therefrom, *Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow* are parched at 100° C. to yield powders.

Then, the steamed *Artemisia vulgaris Linne* and *Morus bombycis Koidzumi* are cut at intervals of 0.5–1 mm and homogeneously mixed with the powders of *Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow*. Thereafter, the extracts from *Arisaema amurense Max var. Serratum Nakai, Brassica juncea Cosson* and *Angelica koreana Maximowicz* are sprayed on the homogeneous mixture with stirring. The resulting herb composition is aged for 10–20 days in a closed container while keeping its moisture content at 18–21%. After being cold-dried to a moisture content of 13–14%, the herb composition is added with 1–10 wt % of starch syrup and 0.1–1 wt % of glycerin on the basis of the weight of the herb composition. The composition is adjusted to have a moisture content of 12–13% and then, made into a form of a cigar or cigarette, to provide an alternate cigarette.

The steam-aging of *Artemisia vulgaris Linne* and *Morus bombycis Koidzumi* allows toxicants to be discharged out of them in advance in order to have the product to be ignited well. Preferably, *Artemisia vulgaris Linne* and *Morus bombycis Koidzumi* are subjected to steam-aging for 1 hour. For example, if the steam-aging is carried out for less than 1 hour, the desirable effects are not expressed completely. On the other hand, if steam-aging is performed too long, it is economically unfavorable in the light of the effective improvement.

In extracting from *Arisaema amurense Max var. Serratum Nakai, Brassica juncea Cosson* and *Angelica koreana Maximowicz*, ethyl alcohol is the most favorable one because it is harmless to the human body. However, all fluids that are conventionally used as extracting solvents in this art can be used. If the alcohol is less than 50% in concentration, *Arisaema amurense Max var. Serratum Nakai, Brassica juncea Cosson* and *Angelica koreana Maximowicz* are put in danger of sepsis. On the other hand, if too high concentrated alcohol is used, it is economically unfavorable.

*Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow* provide the fragrance peculiar to herb medicines, allow the product to be ignited well and modify the harmful elements into harmless ones. When these herbs are parched at a temperature less than 100° C., the desired goals cannot be obtained fully. On the other hand, upon parching at a temperature higher than 100° C., it is difficult to execute this step and carbonization may occur.

With the aim of facilitating the aggregation of the herb components and improving the flavor of the alternate product, starch syrup and glycerin are preferably added within the above-mentioned range. For example, if they are used too little, the flavor effect is poor. On the other hand, if they are added in excess, it takes a long time to dry them, so that it is economically unfavorable. In addition, excess starch syrup and glycerin result in an over-aggregation of the herb components, which requires an additional pulverization process.

A better understanding of the present invention may be obtained through the following example which is set forth to illustrate, but is not to be construed as the limit of the present invention.

EXAMPLE 100 g of *Artemisia vulgaris Linne* and 150 g of *Morus bombycis Koidzumi* were steamed in a steam kettle, dried and cut at intervals of 0.5–1 mm. 300 g of *Arisaema amurense Max var. Serratum Nakai*, 300 g of *Brassica juncea Cosson* and 300 g of *Angelica koreana Maximowicz* were immersed in 3 liters of 60% ethyl alcohol for 100 days, to extract medicinal ingredients which were, then, filtered.

Separately, 150 g of *Asiasarum heterotropoides var. seoulense F. Maekawa*, 200 g of *Eugenia caryophyllata Thunberg*, 150 g of *Cnidium officinale Makino*, 150 g of *Evodia officinalis Dode*, 100 g of *Thuja oriental is Linne*, 100 g of *Ziziphus jujuba Miller* and 100 g of *Polygala tenuifolia Willdenow* were parched and then, broken into powders.

The *Artemisia vulgaris Linne* and *Morus bombycis Koidzumi* pieces and the *Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow* powders were homogeneously mixed each other while spraying the *Arisaema amurense Max var. Serratum Nakai, Brassica juncea Cosson* and *Angelica koreana Maximowicz* extracts thereon. Thereafter, the resulting mixture was dried to a moisture content of 18–21% and aged for 15 days in a closed container. Again, after being dried to a moisture content of 13–14%, the mixture was added with 50 g of starch syrup and 5 g of glycerin, followed by reducing the moisture content to 12–13%. Finally, this composition thus obtained was made into a form of cigarette or cigar.

A chemical analysis showed that neither the alternate cigarette according to the present invention nor the smoke therefrom contained nicotine. The alternate was found to be good in favor via a sensuous test in which 100 men had a smoke with the alternate.

As described hereinbefore, the alternate cigarette in accordance with the present invention is in a form of cigar or cigarette with a moisture content of 12–13%, which is prepared from a composition comprising a herb medicinal mixture of *Artemisia vulgaris Linne, Morus bombycis Koidzumi, Ziziphus jujuba Miller, Polygala tenuifolia Willdenow, Asiasarum heterotropoides var. seoulense F. Maekawa, Eugenia caryophyllata Thunberg, Cnidium officinale Makino, Evodia officinalis Dode* and *Thuja orientalis Linne* powders and *Arisaema amurense Max var. Serratum Nakai, Angelica koreana Maximowicz* and *Brassica juncea Cosson* extracts, in combination with 1–10 wt % of starch syrup and 0.1–1 wt % of glycerol on the basis of the weight of the herb medicinal mixture. With the alternate cigarette, a smoker can be restrained from smoking, get rid of tension and stress and relieve himself or herself from the smoking motives, such as psychological tone, anxiousness, wrath, melancholy, etc, while feeling a smoking sense and obtaining medical effects including cough remedy, discharge of phlegm and mental serenity.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for preparing an alternate cigarette, which comprises (a) mixing starch syrup and glycerin in an amount of 1–10 wt % and 0.1–1 wt %, repectively, based on the weight of a herb medicinal mixture consisting of a solid portion comprising 7–38 wt % of a mixture of *Artemisia vulgaris Linne, Ziziphus jujuba Miller, Polygala tenuifolia Willdenow, Asiasarum heterotropoides var. seoulense F. Maekawa, Eugenia caryophyllata Thunberg, Eyodia officinalis Dode* and *Thuja orientalis Linne* and 10–41 wt % of a mixture of *Morus bombycis Koidzumi* and *Cnidium officinale Makino* and a liquid portion comprising 15–30 wt % of *Arisaema amurense Max var. Serratum Nakai, Angelica koreana Maximowics* and *Brassica juncea Cosson* extracts, based on the weight of the solid portion;

(b) drying the resulting mixture to a moisture content of 12–13%; and (c) forming it into the form of a cigar or cigarette.

2. A method in accordance with claim 1, wherein *Artemisia vulgaris Linne* and *Morus bombycis Koidzumi* are steam-aged, dried and cut into pieces.

3. An alternate cigarette, prepared by the method of claim 2.

4. A method in accordance with claim 1, wherein *Arisaema amurense Max var. Serratum Nakai, Brassica juncea Cosson* and *Angelica koreana Maximowicz* are immersed in an alcohol to extract pharmaceutical ingredients.

5. A method in accordance with claim 4, wherein said alcohol is an ethyl alcohol solution with an alcohol content ranging from 50–70%.

6. An alternate cigarette, prepared by the method of claim 5.

7. An alternate cigarette, prepared by the method of claim 4.

8. A method in accordance with claim 1, wherein said *Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow* are parched and pulverized into powders.

9. An alternate cigarette, prepared by the method of claim 8.

10. A method in accordance with claim 1, wherein said alternate is free of tobacco components and consists of herb medicines.

11. An alternate cigarette, prepared by the method of claim 10.

12. An alternate cigarette, prepared by the method of claim 1.

13. A method in accordance with claim 1, wherein *Artemisia vulgaris Linne* and *Morus bombycis Koidzumi* are steam-aged, dried and cut into pieces.

14. A method in accordance with claim 1, wherein *Arisaema amurense Max var. Serratum Nakai, Brassica juncea Cosson* and *Angelica koreana Maximowicz* are immersed in an alcohol to extract pharmaceutical ingredients.

15. A method in accordance with claim 14, wherein said alcohol is an ethyl alcohol solution with an alcohol content ranging from 50–70%.

16. A method in accordance with claim 1, wherein said *Asiasarum heterotropoides var. seoulense F. Maekawa, Eugenia caryophyllata Thunberg, Cnidium officinale Makino, Evodia officinalis Dode, Thuja orientalis Linne, Ziziphus jujuba Miller* and *Polygala tenuifolia Willdenow* are parched and pulverized into powders.

17. A method in accordance with claim 1, wherein said alternate is free of tobacco components and consists of herb medicines.

18. An alternate cigarette, prepared by the method of claim 1.

* * * * *